US008220192B2

(12) United States Patent
Fluhr et al.

(10) Patent No.: US 8,220,192 B2
(45) Date of Patent: Jul. 17, 2012

(54) FIRING ASSEMBLIES FOR USE WITH FIREARMS

(75) Inventors: Norbert Fluhr, Oberndorf (DE); Hermann Albrecht, Oberndorf (DE); Wolfgang Bantle, Oberndorf (DE); Johann-August Bantle, Böblingen (DE); Erwin Epp, Dorhan (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 307 days.

(21) Appl. No.: 12/511,819

(22) Filed: Jul. 29, 2009

(65) Prior Publication Data

US 2010/0037502 A1 Feb. 18, 2010

Related U.S. Application Data

(63) Continuation of application No. PCT/EP2008/000732, filed on Jan. 30, 2008.

(30) Foreign Application Priority Data

Jan. 30, 2007 (DE) ..... 10 2007 004 588

(51) Int. Cl.
*F41A 3/00* (2006.01)

(52) U.S. Cl. ..... 42/69.03; 42/69.01; 89/146; 89/144

(58) Field of Classification Search ..... 42/90, 92, 42/41, 42.01, 65, 42.03, 39.01, 69.03; 89/147, 89/131, 141, 143, 146

See application file for complete search history.

(56) References Cited

U.S. PATENT DOCUMENTS

| | | | | |
|---|---|---|---|---|
| 1,387,369 | A * | 8/1921 | Duffek | 89/146 |
| 5,166,458 | A * | 11/1992 | Yoo | 42/69.03 |
| 5,713,150 | A | 2/1998 | Ealovega | |
| 5,915,935 | A | 6/1999 | Weldle et al. | |
| 2006/0207147 | A1 | 9/2006 | Lazor | |

FOREIGN PATENT DOCUMENTS

CA 2590831 6/2006

(Continued)

OTHER PUBLICATIONS

Patent Cooperation Treaty, "Written Opinion," issued by the International Searching Authority in connection with international counterpart PCT application No. PCT/EP2008/000732, mailed Jun. 5, 2008, 10 pages.

(Continued)

*Primary Examiner* — Michael Carone
*Assistant Examiner* — Daniel Troy
(74) *Attorney, Agent, or Firm* — Hanley, Flight & Zimmerman, LLC

(57) ABSTRACT

Firing assemblies for use with firearms are described. A firing assembly for use with a firearm includes a hammer pivotably coupled to a hammer shaft. The hammer includes a hammer stop notch that at least partially engages a portion of a lever of a trigger assembly when the hammer is in a cocked position and a control curve section that engages a surface of the lever to retain the lever in an unlocked position as the hammer moves between the cocked position and a firing position. Additionally, the firing assembly includes a control element pivotably coupled to the hammer shaft and adjacent the hammer, wherein the control element includes a first control curve portion that at least partially adjoins the control curve section and wherein the hammer interacts with the control element to change a control curve region as the hammer moves between cocked position and the firing position.

20 Claims, 5 Drawing Sheets

FOREIGN PATENT DOCUMENTS

| | | |
|---|---|---|
| DE | 198 46 657 C2 | 2/2001 |
| DE | 202005020845 | 9/2006 |

OTHER PUBLICATIONS

Patent Cooperation Treaty, "International Search Report," issued by the International Searching Authority in connection with international counterpart PCT application No. PCT/EP2008/000732, mailed Jun. 5, 2008 , 4 pages.

International Bureau, "International Preliminary Report on Patentability", issued in connection with PCT application Serial No. PCT/EP2008/000732, issued Aug. 4, 2009 (8 pages).

* cited by examiner

FIRING ASSEMBLIES FOR USE WITH FIREARMS

RELATED APPLICATION

This patent is a continuation of International Patent Application Serial No. PCT/EP2008/000732, filed Jan. 30, 2008, which claims priority to German Patent Application 10 2007 004 588.5, filed on Jan. 30, 2007, both of which are hereby incorporated herein by reference in their entireties.

FIELD OF THE DISCLOSURE

This patent relates generally to firing assemblies and, more specifically, to firing assemblies for use with firearms.

BACKGROUND

Known firearms may be provided with mechanisms that prevent faulty operation of safety equipment, which may impact the operability of a trigger assembly. For example, the hammer of some known firearms includes a control curve section having a cam-like peripheral surface that is concentric to a pivoting axis and/or hammer shaft of the hammer.

Such known firearms may include a release element designed as a rocking arm or lever. Toward a front end of the lever, a trigger bar is positioned. A rear end of the lever may interact with control surfaces and/or a cam area of a safety shaft. The lever is typically mounted between the ends about a pivoting axis that defines a center of rotation. In operation, when the trigger is moved, the lever tilts about the center of rotation to release the hammer from the cocked position. As the front surface of the trigger bar disengages a hammer stop notch of the hammer, the control curve section of the hammer moves relative to and engages the trigger bar to hold the lever in an unlocked position (e.g., a firing position). Generally, the trigger bar acts as a control surface that is urged toward the control curve section of the hammer via a trigger spring. Additionally, the engagement between the trigger bar and the control curve section of the hammer positions the other end of the lever toward and/or into engagement with the safety barrel such that the safety barrel cannot be moved from the unlocked position (e.g., the firing position) to the locked position (e.g., the safety position). As a result, the hammer may freely move between the firing position and the cocked position.

The engagement between the other end of the lever and the safety barrel ensures that the loading process of the firearm is not affected and that the trigger assembly is not damaged during the loading process. However, if the safety shaft were to be moved to the locked position when the hammer is in the firing position, the hammer may damage the trigger assembly and/or the firing mechanism as the hammer returns to the cocked position. The M16 rifle and U.S. Pat. No. 5,713,150 utilize and/or describe a similar known firing/safety mechanism as described above.

Generally, trigger weight is associated with the amount of force required to activate the trigger (e.g., the trigger lug). The trigger weight of the firing unit or trigger device described above may be dependent on several factors such as, the amount of tension that urges the trigger bar toward a catching position (e.g., engaging position) and a frictional force between the hammer stop notch and the front surface of the trigger bar. To disengage the trigger bar from the hammer stop notch, the friction between the opposing surfaces must be overcome. The amount of friction between the opposing surfaces may be associated with an angle of engagement (e.g., active surface direction) of the hammer stop notch relative to the front surface of the trigger bar, the friction coefficient between the opposing surfaces, and the amount of force that presses the hammer stop notch against the trigger bar. The amount of force that presses the hammer stop notch against the trigger bar is associated with the tension of, for example, a hammer spring and the effectiveness of the lever arm (e.g., the effective distance between the hammer stop notch and the pivoting axis of the hammer). Generally, the closer the hammer stop notch is positioned relative to the pivoting axis, the larger the frictional force between the hammer stop notch and the trigger bar becomes.

The lever arm also dictates the required pivoting space of the control curve section within the housing of the firearm. The control curve section may begin adjacent the hammer stop notch and follow relatively close to the pivoting axis if the lever arm is relatively short or follow relatively far from the pivoting axis if the lever arm is relatively long. A relatively high trigger weight of between about 35 and 40 Newton (e.g., 3.5-4 kilopond) may impact shooting accuracy. In contrast, a relatively lower trigger weight of between about 15-20 Newton (1.7-2 kilopond) may have a lesser impact on shooting accuracy.

There are a number possibilities to reduce trigger weight of a firearm. For example, the friction coefficient between the opposing surfaces of the hammer stop notch and the end of the trigger bar may be treated by, for example, sanding, polishing, coating, etc. However, such an approach is relatively costly to implement and due to the high stresses to which these components are exposed, the treatment may not be very durable.

Alternatively, the angle of engagement (e.g., direction toward each other) between the hammer stop notch and the end of the trigger bar may be changed to decrease the amount of engagement between these surfaces (e.g., the tendency of these two surfaces to jam together). However, such an approach may only be implemented if high production precision is maintained, which increases production costs. Additionally, by changing the angle of engagement, the trigger bar may not function as reliability, thereby enabling the hammer to be released if the firearm is subjected to outside forces (e.g., dropping, hits, vibrations, etc.).

Another option is to reduce the trigger tension, which correspondingly decreases the friction force between the opposing surfaces of the hammer stop notch and the end of the trigger bar and decreases the trigger weight. However, decreasing the trigger tension correspondingly decreases the force imparted via the hammer on a firing pin during firing and, thus, in a worst case scenario, cartridges may not be ignited reliably.

The above described options to decrease trigger weight in a precise and reliable manner all require relatively high production precision to maintain the relatively low trigger weight during long periods without complex maintenance.

Another option to change the trigger weight is to vary the effective lever arm. Such an approach enables the designated effective force to be controlled without considerably increasing production cost.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples described herein relate to firing assemblies or units that provide a firearm with a relatively low trigger weight without impacting other functionalities (e.g., the trigger mechanism, the safety mechanism) of the firearm. Additionally, the examples described herein provide the firearm with a relatively low trigger weight without increasing the pivoting space within the housing required to enable a hammer to move between the cocked position and the firing position. Specifically, the examples described herein relate to a control element that is pivotable relative to and positioned adjacent to a hammer. Generally, in some rotational arrangements, portions of the control element and the hammer together form a continuous control curve region to engage a single release element. The hammer may be locked in the cocked position via an interaction between a hammer stop notch of the hammer and a corresponding surface of a release element such as, for example, a trigger bar as described in DE 198 46 657/2, which is hereby herein incorporated by reference in its entirety. The hammer includes a control curve section which, when the hammer moves from the cocked position to the firing position, engages a surface of the release element, thereby holding the release element in an unlocked position (e.g., firing position, non-lockable position).

Figure 1:
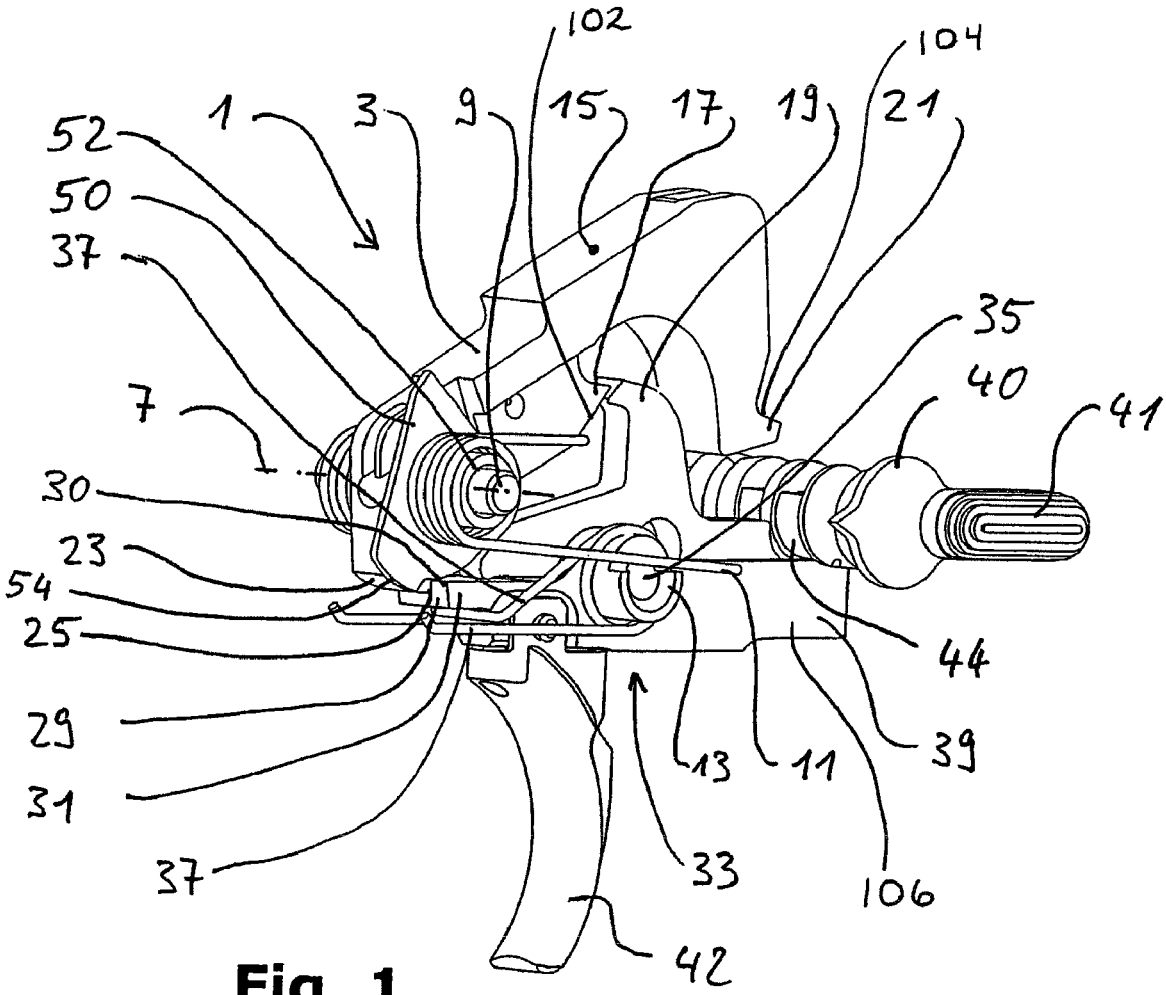
FIG. 1 depicts an example firing assembly having an example control element.
Figure 2:
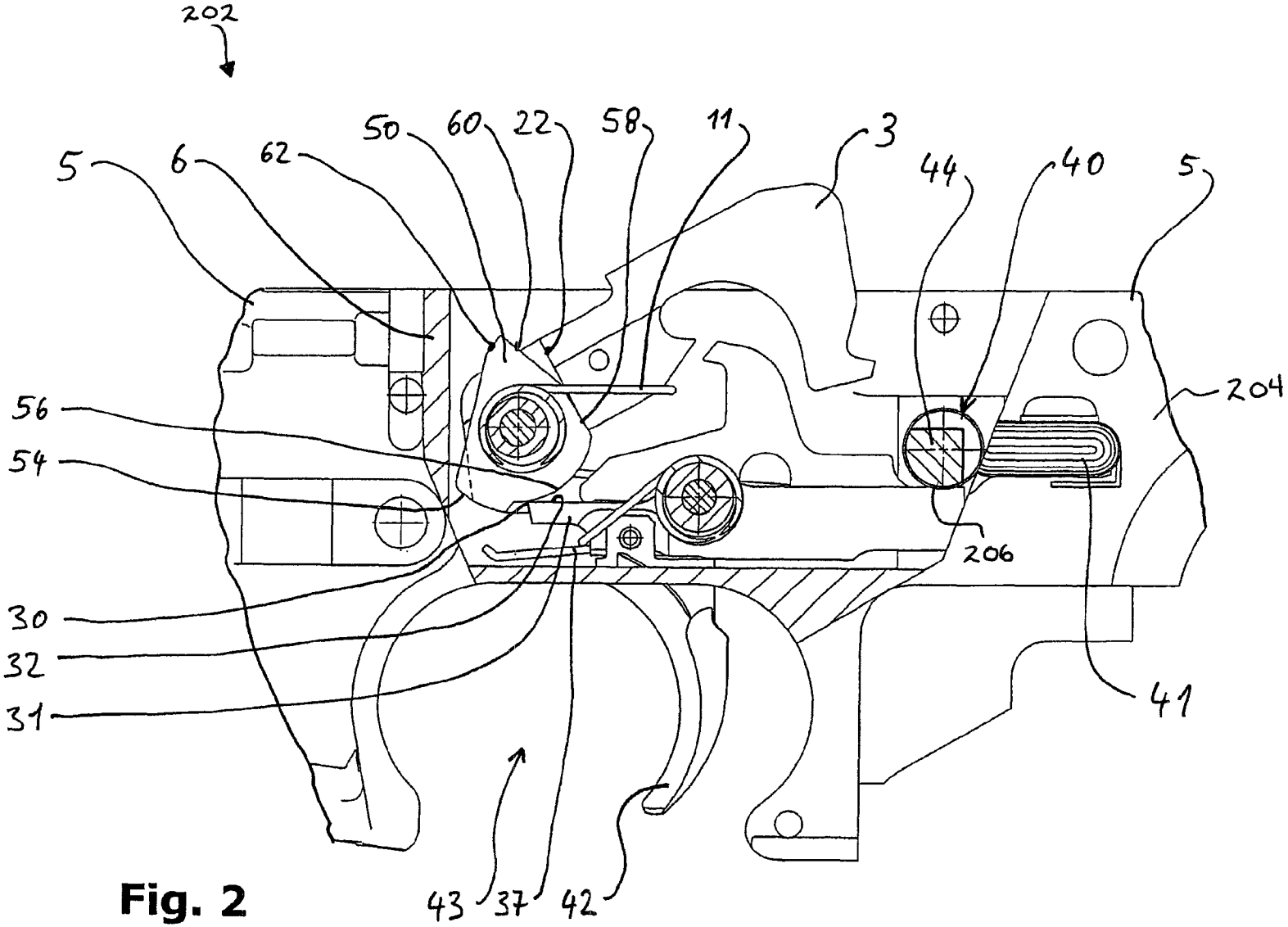
FIG. 2 depicts the example firing assembly in a cocked positioned in a housing of a firearm.

FIG. 1 depicts a firing unit, firing assembly or hammer release assembly 1 having a hammer 3 in a cocked position and FIG. 2 depicts the firing assembly 1 in a housing 5 of a firearm or weapon 202. Generally, the hammer 3 is positioned at least partially in the housing 5 and is rotatably coupled to a hammer shaft or swing shaft 9 having a pivoting axis 7. To preload the hammer 3 in the firing direction, the hammer 3 is biased via a leg spring or hammer spring 11 that is positioned between and engages a surface 102 of the hammer 3 and a stop 13 of a trigger shaft 35. Therefore, when the hammer 3 is released from the cocked position, as discussed below, the hammer 3 moves to the firing position (see FIG. 3) to enable a surface or blade 15 of the hammer 3 to strike a firing pin (not shown) to discharge a round.

Additionally, the hammer 3 includes a catch nose 17 that interacts with a breaker or catch 19. To provide the firearm 202 with continuous firing functionality (e.g., automatic firing ability), a catch 21 is positioned toward an end 104 of the hammer 3.

The hammer 3 includes a control curve section, first curved surface or portion 23 having an edge 25 adjacent a hammer stop notch or detent surface 27. Specifically, the hammer stop notch 27 may be at an angle (e.g., a ninety degree angle or any other suitable angle, running rectangular to) relative to the control curve section 23. The interaction between the hammer stop notch 27 and an end or front surface 29 of a lever or release element 106 enables the hammer 3 to be retained in the cocked position, as shown in FIGS. 1 and 2. Specifically, the hammer 3 may be retained and/or locked in the cocked position via the end 29 of the lever 106 and/or a trigger assembly 33 that may be designed as a sear catch 31.

The trigger assembly 33 may be rotatably coupled and/or swivel-mounted in the housing 5 of the firearm 202 via the trigger shaft 35. Additionally, the end 29 and/or the sear catch 31 of the trigger assembly 33 may be urged toward the hammer 3 via a trigger spring or leg spring arrangement 37. As discussed above, the end 29 and the hammer stop notch 27 may engage to enable the hammer 3 to be retained in the cocked position. To provide the firearm 202 with safety functionality, an end 39 (e.g., a rear end 39) of the lever 106 and/or the trigger assembly 33 may interact (e.g., penetrate into) respective cam areas 44 of a safety barrel or shaft 40. The safety shaft 40 is movable (e.g., twistable) between, for example, a "safety" position (e.g., a locked position) and a "firing" position (e.g., an unlocked position) via a lever 41 (e.g., an operating lever) positioned on an exterior portion 204 of the housing 5.

The trigger assembly 33 includes a trigger or trigger lug 42 that at least partially protrudes from the housing 5 of the firearm 202 proximate a trigger guard 43. To release the hammer 3 from the cocked position, the trigger 42 may be moved toward the rear of the firearm 202, thereby rotating the trigger assembly 33 against a force of the trigger spring 37 and disengaging the sear catch 31 from the hammer stop notch 27. Specifically, as the trigger assembly 33 is rotated relative to the hammer 3, the end 29 moves relative to the hammer stop notch 27 until, for example, a release edge 30 of the lever 106 is adjacent the edge 25 of the control curve section 23, thereby enabling the hammer 3 to move (e.g., snap) to the firing position, as shown in FIG. 3, via a force exerted by the hammer spring 11.

A control element or flat cam disc 50 is rotatably coupled to the hammer shaft 9 via a socket or fastener 52 and positioned adjacent the hammer 3. The control element 50 includes a first control curve portion, first curved portion or region 54 that may be laterally positioned relative to the control curve section 23. Additionally, at least some of the first control curve potion 54 may have a similar shape and/or contour as the control curve section 23 and together provide the firearm 202 with a control curve region. Specifically, the first control curve portion 54 may have a radius of curvature that is substantially equal to the radius of curvature of the control curve section 23. In some examples, the first control curve portion 54 may radially extend from the control curve section 23 of the hammer 3, thereby effectively expanding the control curve section 23. In the cocked position, as depicted in FIGS. 2 and 3, a second control curve portion or region 56 of the control element 50 may engage and/or be positioned adjacent to the release edge 30 of the lever 106 and/or a surface or control surface 32 of the lever 106, thereby controlling an amount and/or depth of engagement between the sear catch 31 and the hammer stop notch 27.

To control an amount of rotation of the control element 50 relative to the hammer 3 when the hammer 3 is in the cocked positioned, as depicted in FIG. 2, the control element 50 includes a first surface or adjusting range 58 that corresponds to and/or engages with a shoulder or tappet area 22 of the hammer 3 to prevent further rotation of the control element 50 relative to the hammer 3.

Figure 3:
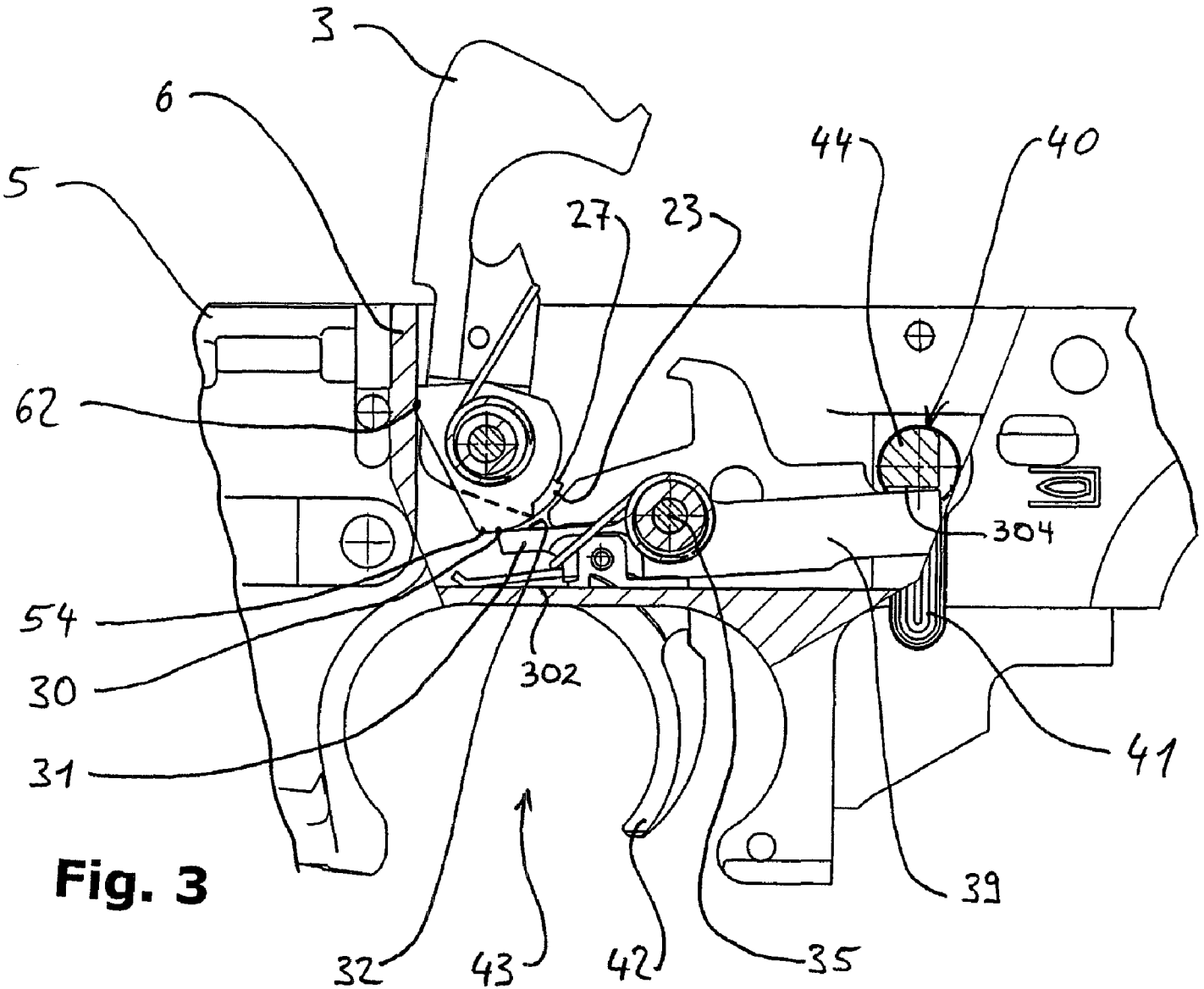
FIG. 3 depicts the example firing assembly in a firing position in the housing of the firearm.

To control an amount of rotation of the control element 50 relative to the hammer 3 as the hammer 3 moves from the cocked position to the firing position, as shown in FIG. 3, the control element 50 includes a second surface or adjusting range 60 that corresponds to and/or engages with the shoulder 22 of the hammer 3 to prevent further rotation of the control element 50 relative to the hammer 3.

In operation, the trigger assembly 33 and/or the lever 106 is moved away from the hammer 3 and/or the control element 50 until, for example, the release edge 30 of the lever 106 disengages the edge 25 of the control curve section 23 and the hammer 3 moves from the cocked position toward the firing position. As the hammer 3 moves toward the firing position, the shoulder 22 of the hammer 3 may move counterclockwise relative to the control element 50. Specifically, the shoulder 22 may move from being adjacent to and/or engaging the first surface 58 to being adjacent to and/or engaging the second surface 60. Generally, as the shoulder 22 moves toward the second surface 60, the hammer 3 moves counterclockwise relative to the control element 50 until the shoulder 22 engages the second surface 60 at which point the hammer 3 moves the control element 50 counterclockwise toward the firing position and a third surface or adjusting range 62 of the control element 50 is positioned adjacent to and/or engages a surface or housing wall 6 of the housing 5, as shown in FIG. 3.

Prior to the shoulder 22 engaging the second surface 60 of the control element 50, as the hammer 3 moves from the cocked position toward the firing position, the control element 50 may turn clockwise relative to the hammer 3, which also rotates (e.g., shifts in a peripheral direction) the first control curve portion 54 of the control element 50 relative to the control curve section 23 of the hammer 3. As a result, in the firing position, the release edge 30 and/or the surface 32 (e.g., an upper side of the sear catch 31) of the lever 106 may be positioned adjacent to and/or engage the first control curve portion 54 of the control element 50 while the control curve section 23 of the hammer 3 may be at a distance from the release edge 30 and/or the surface 32 of the lever 106. Generally, the interaction between the first control curve portion 54 and the sear catch 31 may urge the end 29 of the trigger assembly 33 toward a surface 302 of the housing 5, as shown in FIG. 3. Additionally, the interaction between the first control curve portion 54 and the sear catch 31 urges the end 39 of the trigger assembly 33 upward to penetrate the respective cam area 44 of the safety shaft 40.

The cam area 44 may be configured to substantially ensure that the safety shaft 40 may not be moved from the "firing" position, as shown in FIG. 3 (e.g., the end 39 of the trigger assembly 33 positioned adjacent to and/or engaging a surface 304 of the cam area 44, the end 39 is positioned at a relative distance from the surface 302 of the housing 5), to the "safety" position, as shown in FIG. 2 (e.g., the end 39 of the trigger assembly 33 positioned adjacent to and/or engaging a surface 206 of the cam area 44, the end 39 is positioned at a relatively smaller distance to the surface 302 of the housing 5). Generally, the interaction between the cam area 44 and the trigger assembly 33 and specifically, the interaction between the surface 304 and the end 39, may enable the hammer 3 to return to the cocked position from the firing position.

Figure 4:
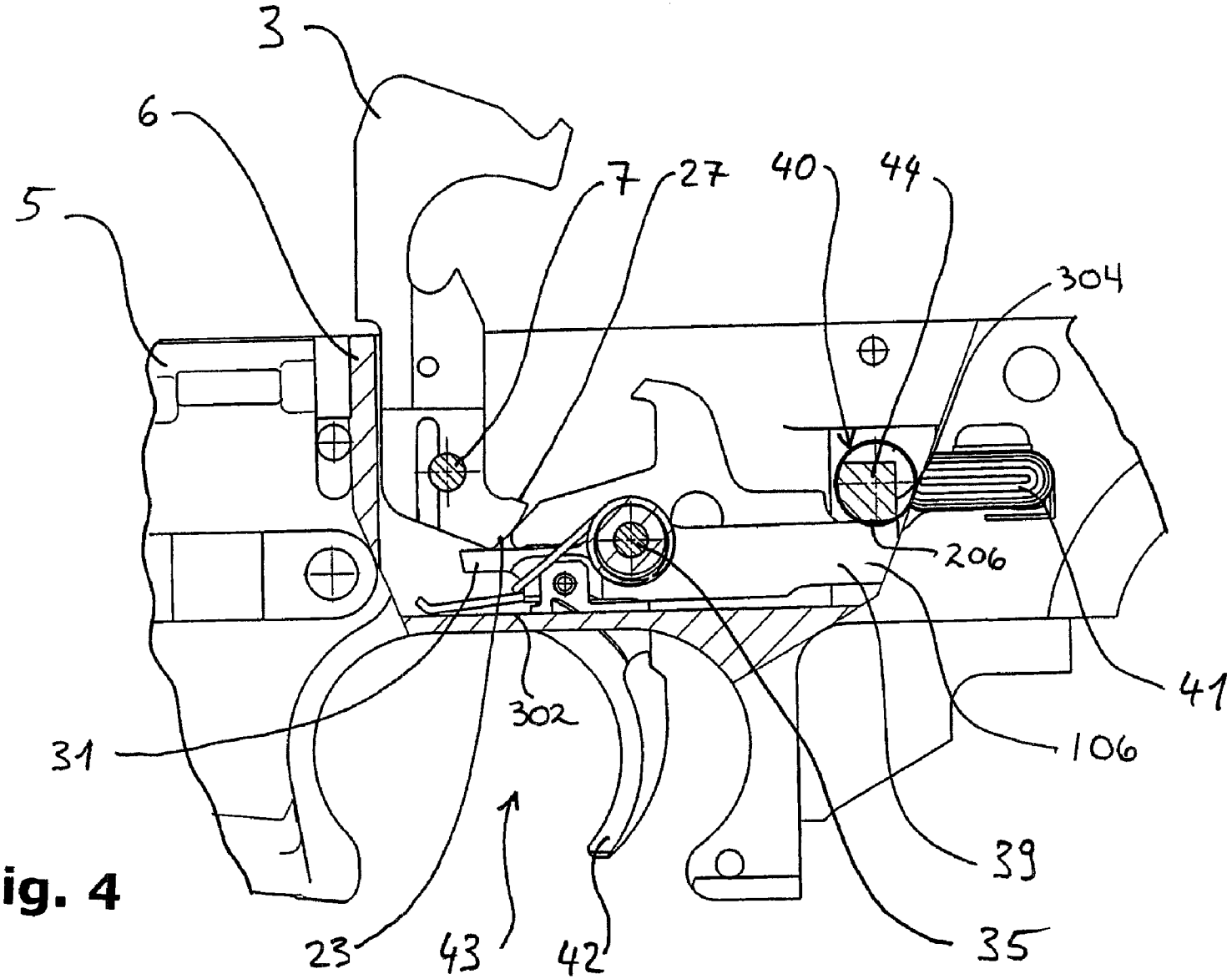
FIG. 4 depicts the example firing assembly in a firing position without the example control element.

As depicted in FIG. 4, if the firearm 202 is not provided with the control element 50, the control curve section 23 of the hammer 3 engages the release edge 30 and/or the surface 32 of the lever 106 as opposed to the first control curve portion 54 of the control element 50. The engagement between the control curve section 23 and the surface 32 enables the end 29 of the lever 106 to be positioned at a greater distance from the surface 302 of the housing 5. As a result, the end 39 of the lever 106 and/or the trigger assembly 33 may be positioned relatively closer to the surface 302 and thus, the end 39 may not be positioned adjacent to and/or engage the surface 304 of the cam area 44 and the safety shaft 40 may be relatively easily moved from the "firing" position to the "safety" position. In the "safety" position, the interaction between the end 39 and the cam area 44 substantially inhibits (e.g., blocks) the movement of the trigger assembly 33. Inhibiting the movement of the trigger assembly 33 may also prevent the hammer 3 from returning to the cocked position from the firing position because of the interaction between the hammer 3 and the sear catch 31. Additionally and/or alternatively, if an attempt were made to return the hammer 3 to the cocked position from the firing position when the firearm 202 is in the "safety" position, the hammer 3 may damage the sear catch 31.

The control element 50 reduces the amount of pivoting space and/or size of the control curve section 23 of the hammer 3 such that, in the cocked position, the hammer 3 is at a distance from the housing wall 6. Such an approach of providing the firearm 202 with the control element 50 provides the firearm 202 with a relatively long lever arm between the pivoting axis 7 and the hammer stop notch 27 while still enabling the hammer 3 to rotate between the cocked position and the firing position without engaging the housing wall 6. Additionally, such an approach relatively reduces the trigger weight on, for example, the hammer stop notch 27 and/or the sear catch 31 because of the position of the hammer stop notch 27 relative to the pivoting axis 7.

As the hammer 3 is moved from the firing position to the cocked position, the control element 50 may rotate toward (e.g., counterclockwise relative to) the hammer 3 until the first surface 58 of the control element 50 engages the shoulder 22 of the hammer 3. After the first surface 58 engages the shoulder 22, the hammer 3 and the control element 50 move clockwise toward the cocked position in which the sear catch 31 is positioned adjacent to and/or engages the hammer stop notch 27. As depicted in FIG. 2, in the cocked position, the hammer 3 nor the control element 50 engage the housing wall 6 and, thus, the hammer 3 may move between the firing position and the cocked position without engaging and/or colliding with the housing wall 6. The rotatability of the control element 50 relative to the hammer 3 enables the first control curve portion 54 to significantly overlap and/or overlay the control curve section 23 when the hammer 3 is in the cocked position, as shown in FIG. 2, thereby reducing a control curve zone and/or region (e.g., the space occupied by the first control curve portion 54 and the control curve section 23 in the housing 5). Additionally, the rotatability of the control element 50 relative to the hammer 3 enables the first control curve portion 54 to overlap less of the control curve section 23 when the hammer 3 is in the firing position, as shown in FIG. 3, thereby increasing the control curve region. Such an approach, advantageously utilizes the pivoting space available in the firearm 202.

The examples described herein may be used as a replacement for another assembly that has a relatively shorter lever arm (e.g., a relatively shorter distance between a pivoting axis and a hammer stop notch). Specifically, the example firing assembly 1 may be implemented on and/or utilized to retrofit an existing firearm (not shown) without modifying, for example, the hammer shaft 9 and/or the trigger shaft 35. In some examples, if a known firearm is implemented with the examples described herein, an existing firing force and/or the trigger force may be maintained. Additionally, the examples described herein may be provided with other known mechanisms, such as locking mechanisms (e.g., the breaker 19, the catch 21) that may interact with, for example, the safety shaft 40. However, depending on the firearm to which the examples described herein are to be implemented on, the safety shaft 40 may be replaced and/or modified.

Figure 5:
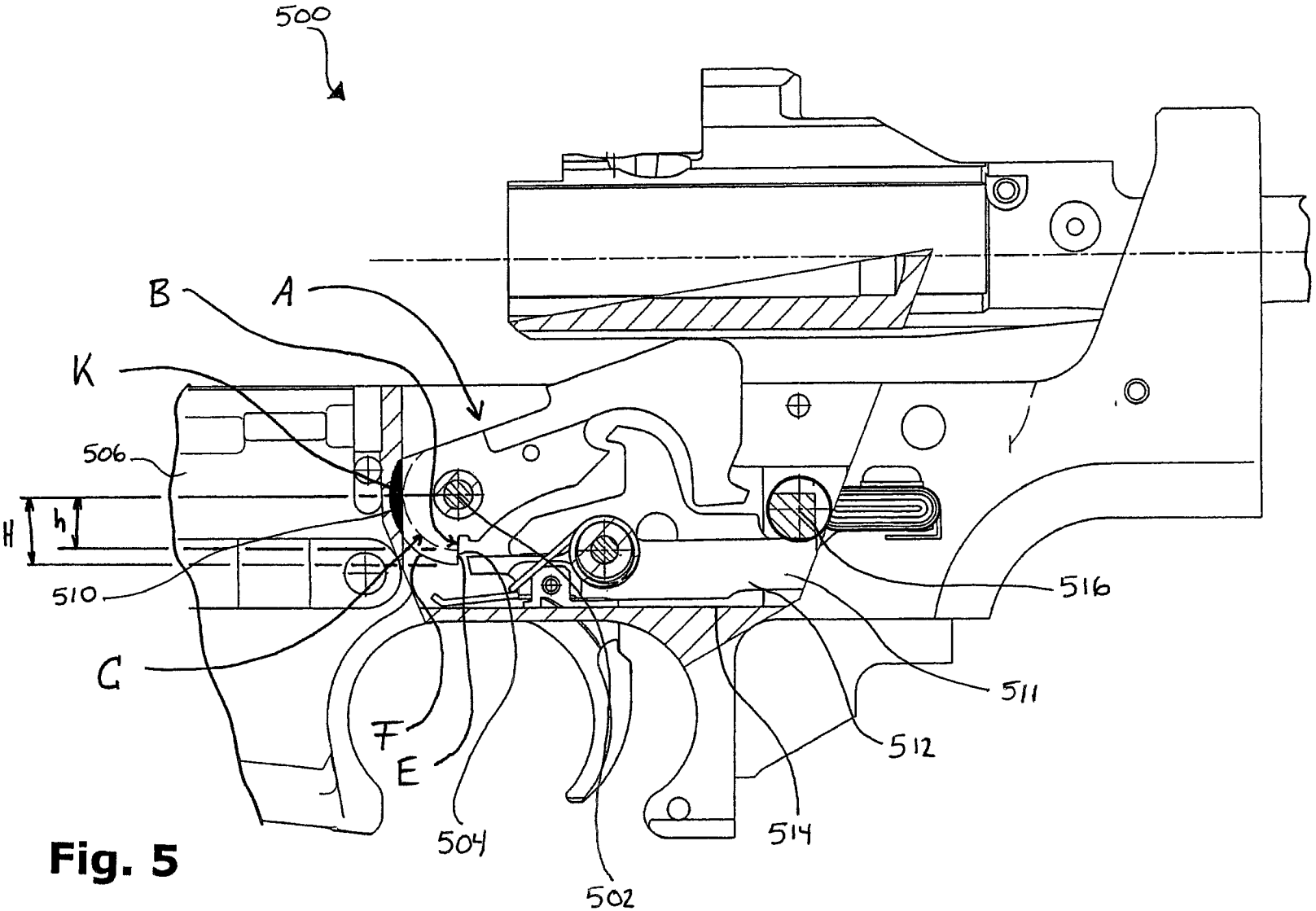
FIG. 5 depicts a modified hammer engaging a housing of a firearm.

FIG. 5 depicts a portion of a firearm 500 that includes a hammer A. Generally, reference letter B represents a hammer stop notch and/or locking outline and reference letter C represents a control curve section and/or a control outline that provide the firearm 500 with a relatively high trigger force. In contrast, reference letter E represents a modified hammer stop notch and/or locking outline and reference letter F represents a modified control curve section and/or a control outline that provide the firearm 500 with a relatively lower trigger force by extending an effective lever arm (e.g., a distance between a pivoting axis 502 and a hammer stop notch 504) from h to H. Additionally, FIG. 5 depicts issues encountered by increasing the effective lever arm. Specifically, by increasing the lever arm from h to H, the control curve region F and/or the modified hammer stop notch E requires a relatively larger amount of pivoting space for the hammer A to pivot as compared to the control curve region C and/or the hammer stop notch B. In some examples, the increase in pivoting space may decrease the practicability of providing the firearm 500 with the hammer A having the control curve region F and/or the modified hammer stop notch F because of an available amount of space in a housing 506 of the firearm 500. Specifically, reducing an amount of trigger weight by providing the firearm 500 with the hammer A having the control curve region F and/or the modified hammer stop notch E would result in an engagement between the control curve region F and a housing wall 508, as represented by reference letter K, which impacts the functionality of the hammer A. To eliminate the engagement K between the control curve region F and the housing wall 508, the firearm 500 would have to be modified via, for example, a cutout, an expansion, etc.

Alternatively, to eliminate the engagement K, a portion 510 of the control curve section F may be truncated and/or eliminated. However, such an approach of eliminating the portion 510, would enable an end 511 of a lever 512 to be positioned relatively closer to a surface 514 of the housing 506. As discussed above, positioning the end 511 relatively closer to the surface 514 may enable a safety shaft 516 to be relatively easily moved from the "firing" position to the "safety" position.

Turning back to FIGS. 1-3, as described above, the examples described herein include the control element 50 that may be used with the hammer 3 and may be pivoted about the pivoting axis 7. The control element 50 includes the first control curve portion 54 that is pivotable relative to the control curve section 23 of the hammer 3. Additionally, the first control curve portion 54 may, in some positions, at least partially overlap the control curve section 23. In operation, the control element 50 may be pivotable relative to the hammer 3 to, for example, expand and/or increase an effective surface and/or control curve region in the pivoting direction. More generally, the control element 50 may expand and/or increase the effective surface and/or control curve region such that the control element 50 engages the surface 32 of the lever 106 while the control curve section 23 of the hammer 3 may be at a distance from the surface 32 when the hammer 3 is in the firing position. As a result, the examples described herein enable the hammer 3 to move between the firing position and the cocked position without engaging the housing wall 6 while providing the hammer 3 with release functionality in the pivoting range. Generally, the pivotability of the control element 50 and providing the control element 50 with the first control curve portion 54 enables a size of the control curve section 23 to be reduced, which also reduces the pivotal space required by the hammer 3 when moving between the firing position and the cocked position. The hammer 3 may be retained in the cocked position via the interaction between the hammer stop notch 27 and the end 29 and/or the release edge 30 of the lever 106 and/or the sear catch 31. The hammer 3 may be provided with the control curve section 23 that, in some positions, may interact with the surface 32 of the lever 106 and/or the sear catch 31 to position the lever 106 in an unlocked (e.g., firing) position.

As discussed above, the control element 50 may be coaxially aligned with the hammer 3 on the hammer shaft 9. The control element 50 may include the first control curve portion 54 that engages the sear catch 31 of the trigger assembly 33 when the hammer 3 is in the firing position. The engagement between the first control curve portion 54 and the sear catch 31 may move the lever 106 and/or the trigger assembly 33 such that the end 39 interacts with and/or engages the cam area 44 and/or the safety shaft 40, thereby preventing the safety shaft 40 from moving from the "firing" position to the "safety" position.

As described above, the trigger weight of the firing assembly 1 may be reduced by increasing the lever arm between the hammer stop notch 27 and the pivoting axis 7. In some examples, the firing assembly 1 or a portion of the firing assembly 1 may be compatible with known firearms such that the firing assembly 1 may be interchangeably utilized to retrofit and/or replace a firing assembly (not shown) of a known firearm (not shown) without increasing the pivoting space within the known firearm. As a result, the examples described herein may be interchanged with known firing assemblies (not shown) without affecting other aspects of the firearm (e.g., safety features and/or functionality). Referring to FIG. 5, the examples described herein may require a similar pivoting space as shown by the control curve region C while including the hammer stop notch 27 that may be similar to the modified hammer stop notch E.

As discussed above, the control element 50 may be a cam disc that may be pivotably coupled to the pivoting axis 7. Additionally, the control element 50 may be pivoted relative to and coaxially aligned with the hammer 3. In some examples, the control element 50 may be positioned proximate and/or adjacent to the hammer 3 such that first control curve portion 54 and the control curve section 23 at least partially overlap (e.g., adjoin and/or merge) and/or have similar contours. The control element 50 may be produced by any suitable method and may be, for example, a stamped part.

As described above, the control element 50 may include the second control curve portion 56 that engages the release edge 30 and/or the sear catch 31 of the lever 106 when the hammer 3 is in the cocked position, thereby controlling the amount of engagement between the hammer stop notch 27 and the end 29 of the lever 106. Advantageously, controlling the amount of engagement between the hammer stop notch 27 and the end 29 may simplify production of the hammer 3 because the amount of precise machining may be reduced. However, the hammer stop notch 27 and the effective control curve section 23 are still typically precisely and/or accurately machined. The second control curve portion 56 may be utilized as a stop to control the position and/or the amount (e.g., depth) of engagement of the end 29 of the lever 106 when the hammer 3 is in the cocked position. Generally, the amount of engagement between the end 29 and the hammer stop notch 27 is associated with a transition range (e.g., an amount of movement of the end 29 relative to the hammer stop notch 27 when transitioning between the cocked position and the firing position) and, thus, an amount of friction that may occur between the end 29 and the hammer stop notch 27. The transition range and/or the amount of friction between the end 28 and the hammer stop notch 27 are associated with the trigger weight. To change (e.g., increase or decrease) the amount of trigger weight, the radius of the second control curve portion 56 may be changed (e.g., increased or decreased).

The control element 50 includes the first surface 58 and the second surface 60 that may be engaged by the shoulder 22 depending on the position of the hammer 3 relative to the control element 50. In operation, the engagement of either of the surfaces 58 or 60 with the shoulder 22 may restrict the rotation of the control element 50 relative to the hammer 3. Additionally, the control element 50 includes the third surface 62 that may engage the housing wall 6 when the hammer 3 is in the firing position. In operation, the first surface 58 may engage the shoulder 22 of the hammer 3 as the hammer 3 returns to and/or is positioned in the cocked position, which may move and/or control the movement of the control element 50 relative to the hammer 3. In some examples, the engagement between the first surface 58 and the shoulder 22 reduces the control curve region (e.g., the space occupied by the first control curve portion 54 and the control curve section 23 in the housing 5) and, thus, the pivoting space of the hammer 3 and/or the control element 50.

As discussed above, the control element 50 includes the second surface 60 that may be engaged by the shoulder 22 as the hammer 3 moves to and/or is positioned in the firing position. Generally, the engagement between the second surface 60 and the shoulder 22 increases the control curve region to enable the first control curve potion 54 to engage the release edge 30 and/or the surface 32 (e.g., the upper side of the sear catch 31) of the lever 106. Additionally, the control element 50 includes the third surface 62 that may engage the housing wall 6 to control the movement of the control element 50 and/or the hammer 3 in the firing position. Additionally, the engagement between the third surface 62 and the housing wall 6 may maximize the control curve region.

The socket 52 may be coaxially mounted on the hammer shaft 9 to guide and/or couple the control element 50 to the hammer shaft 9. In some examples, the socket 52 may enable the control element 50 to move relative to the hammer 3 and/or maintain the axial position of the control element 50 (e.g., prevent the control element 50 from tilting in operation). Advantageously, the socket 52 may enable relatively large manufacturing tolerances between an outer surface of the hammer shaft 9 and an inner surface of the socket 52.

As discussed above, the firing assembly 1 may be interchanged with known firing assemblies of known firearms. As a result, the trigger weight of the known firearms may be reduced without affecting other aspects of the firearm (e.g., safety features and/or functionality).

As described above, the hammer 3 may include the catch nose 17 that interacts with the breaker or catch 19. To provide the firearm 202 with continuous firing functionality (e.g., automatic firing ability), the catch 21 is positioned toward the end 104 of the hammer 3. As a result, the example described herein may be utilized with semi-automatic and/or automatic weapons.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A control element for use with a hammer of a firearm, wherein the hammer includes a hammer stop notch that at least partially engages a corresponding surface of a release element to lock the hammer in a cocked position and a control curve section that engages a surface of the release element to hold the release element in an unlocked position as the hammer moves between the cocked position and a firing position; wherein the control element comprises:

a first control curve portion of the control element that adjoins and is pivotably adjustable in a pivoting direction of the hammer relative to the control curve section, wherein the control element extends an arc length of the control curve section in the pivoting direction of the hammer depending on a pivoting position of the hammer, wherein the first control curve portion engages the surface of the release element to reduce the required pivoting space of the control curve section and the first control curve portion as the hammer moves between the cocked position and the firing position.

2. The control element as defined in claim 1, wherein the control element comprises a cam disc that is pivotal relative to and coaxially aligned with a pivoting axis of the hammer.

3. The control element as defined in claim 1, wherein the control element includes a second control curve portion different from the first control curve portion that controls a depth of engagement between the hammer stop notch and the release element when the hammer is in the cocked position.

4. The control element as defined in claim 1, wherein the control element includes a first surface that engages a shoulder of the hammer when the hammer is in the cocked position to control movement of the control element relative to the hammer.

5. The control element as defined in claim 4, wherein the control element includes a second surface that engages the shoulder of the hammer when the hammer moves toward the firing position to control the movement of the control element relative to the hammer.

6. The control element as defined in claim 5, wherein the control element includes a third surface that engages a surface of a housing when the hammer is in the firing position.

7. The control element as defined in claim 1, further comprising socket to rotatably couple the control element on a hammer shaft.

8. The control element as defined in claim 1, wherein the first control curve portion of the control element engages a sear catch of a trigger assembly when the hammer is in the firing position to move an end of the trigger assembly into engagement with a portion of a safety barrel to prevent the safety barrel from moving to a safety position.

9. A firing assembly for use with a firearm, comprising:

a hammer pivotably coupled to a hammer shaft, wherein the hammer comprises:

a hammer stop notch that at least partially engages a portion of a lever of a trigger assembly when the hammer is in a cocked position; and a control curve section that engages a surface of the lever to retain the lever in an unlocked position as the hammer moves between the cocked position and a firing position; and a control element pivotably coupled to the hammer shaft and adjacent the hammer, wherein the control element includes a first control curve portion that at least partially adjoins the control curve section and is pivotable in a pivoting direction of the hammer and wherein the hammer interacts with the control element to extend an arc length of the control curve section as the hammer moves between the cocked position and the firing position.

10. The firing assembly as defined in claim 9, wherein as the hammer moves toward the cocked position, a shoulder of the hammer engages a first surface of the control element to decrease the control curve section.

11. The firing assembly as defined in claim 10, wherein as the hammer moves toward the firing position, the shoulder engages a second surface of the control element to increase the control curve section.

12. The firing assembly as defined in claim 11, wherein a third surface of the control element engages a surface of the firearm when the hammer is in the firing position.

13. The firing assembly as defined in claim 9, wherein in the firing position, the first control curve portion at least partially engages the lever to retain the lever in an unlocked position and the control curve section is at a distance from the lever.

14. The firing assembly as defined in claim 9, wherein the control element includes a second control curve portion different from the first control curve portion that controls a depth of engagement between the hammer stop notch and the lever when the hammer is in the cocked position.

15. The control element as defined in claim 9, wherein the control element comprises a cam disc that is pivotal relative to and coaxially aligned with a pivoting axis of the hammer.

16. The firing assembly as defined in claim 9, wherein when the hammer is in the firing position, the first control curve portion engages the surface of the lever to move an end of the lever into engagement with a portion of a safety barrel to prevent the safety barrel from moving to a safety position.

17. A firing assembly for use with a firearm, comprising:

a hammer pivotably coupled to a shaft, wherein the hammer comprises:

a hammer stop notch that at least partially engages a portion of a trigger assembly when the hammer is in a cocked position;

a first curved surface extending from an end of the hammer stop notch the first curved surface having a first radius of curvature; and a shoulder;

a control element pivotably coupled to the shaft adjacent the hammer and movable relative to the hammer, wherein the control element comprises:

a second curved surface having a second radius of curvature substantially equal to the first radius of curvature and at least partially overlaps the first curved surface, the second curved surface pivotable in a pivoting direction of the hammer, wherein an interaction between the hammer shoulder and the control element changes an amount that the second curved surface overlaps the first curved surface and a control curve section that engages a surface of a lever to retain the lever in an unlocked position as the hammer moves between the cocked position and a firing position.

18. The firing assembly as defined in claim 17, wherein as the hammer moves toward the cocked position, the hammer shoulder engages a first surface of the control element to prevent further rotation of the control element relative to the hammer and increase an amount that the second curved surface overlaps the first curved surface.

19. The firing assembly as defined in claim 18, wherein as the hammer moves toward the firing position, the hammer shoulder engages a second surface of the control element to prevent further rotation of the control element relative to the hammer and decrease an amount that the second curved surface overlaps the first curved surface.

20. The firing assembly as defined in claim 19, wherein a third surface of the control element engages a surface of the firearm when the hammer is in the firing position.

* * * * *